US005422444A

United States Patent [19]

Döragrip

[11] Patent Number: 5,422,444

[45] Date of Patent: Jun. 6, 1995

[54] MUFFLER FOR AN INTERNAL COMBUSTION ENGINE

[76] Inventor: Fridolf A. G. Döragrip, Backsvalevägen 17,, S-560 27 Tenhult, Sweden

[21] Appl. No.: 162,458

[22] Filed: Dec. 3, 1993

[30] Foreign Application Priority Data

Jan. 22, 1993 [SE] Sweden ..... 9300196

[51] Int. Cl.[6] ..... F01N 3/02

[52] U.S. Cl. ..... 181/230; 181/258; 181/282

[58] Field of Search ..... 181/230, 231, 232, 240, 181/250, 258, 272, 282; 60/299, 302

[56] References Cited

U.S. PATENT DOCUMENTS

| | | | |
|---|---|---|---|
| 991,515 | 5/1911 | Karminski et al. | 181/250 |
| 3,798,769 | 3/1974 | Bailey | 181/231 |
| 4,867,270 | 9/1989 | Wissmann et al. | 181/231 |
| 4,972,921 | 11/1990 | Takada et al. | 181/282 |

*Primary Examiner*—Howard B. Blankenship
*Assistant Examiner*—Khanh Dang

[57] ABSTRACT

A muffler, especially for an internal combustion engine of a chain saw, comprises a primary and a secondary chamber through which exhaust gases from the engine in turn flow. The primary chamber (10) is formed by an inner, generally spherical receptacle (11) which is surrounded by an outer receptacle (12), and the secondary chamber (13) is formed by the space between the receptacles. The dimensions of the receptacles are such that the volumes of the chambers are generally equal.

9 Claims, 4 Drawing Sheets

MUFFLER FOR AN INTERNAL COMBUSTION ENGINE

BACKGROUND OF THE INVENTION

The present invention relates to a muffler, especially for an internal combustion engine of a chain saw, comprising a primary and a secondary chamber through which exhaust gases from the engine in turn flow.

In hand-held power-driven tools such as chain saws it is essential that weight can be kept as low as possible. It is therefore an object of the invention to provide a muffler having a reduced weight. Another object is to provide a muffler with improved acoustic properties.

SUMMARY OF THE INVENTION

The objects mentioned above have been achieved by means of a muffler including a primary and a secondary chamber through which exhaust gasses from the engine in turn flow. The muffler according to the invention is characterized in that the primary chamber is formed by an inner, generally spherical receptacle which is surrounded by an outer receptacle, and that the secondary chamber is formed by a space between said two receptacles, said receptacles having such mutual dimensions that the volumes of said chambers are generally equal.

BRIEF DESCRIPTION OF THE DRAWINGS

The invention will be described in more detail below with reference to the accompanying drawings, in which.

DETAILED DESCRIPTION OF PREFERRED EMBODIMENTS

Figure 1:
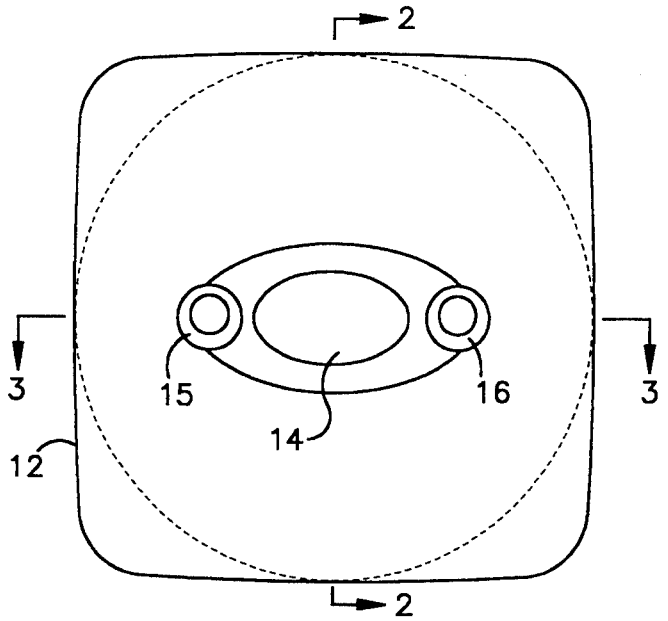
FIG. 1 illustrates a front view of a first embodiment of the muffler according to the invention.

The muffler shown in FIGS. 1–4 comprises a primary chamber 10 formed by an inner, generally spherical-shaped receptacle 11 which is in turn surrounded by an outer, generally cubically-shaped receptacle 12 with rounded corners. The space between the two receptacles 11 and 12 forms a secondary chamber 13. The muffler has an inlet 14 adapted to be connected to an exhaust port of an i. c. engine (not shown), and to this end two spacer tubes 15, 16 are provided which extend through the muffler and are adapted to receive fastening screws (not shown) for attaching the muffler to the engine with the inlet forming a gas-tight connection to said exhaust port.

Figure 2:
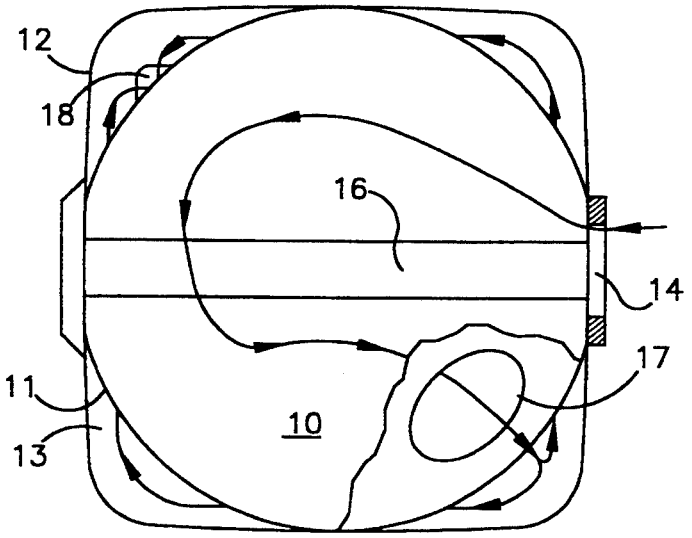
FIG. 2 illustrates a sectional view taken along line II—II in FIG. 1.
Figure 3:
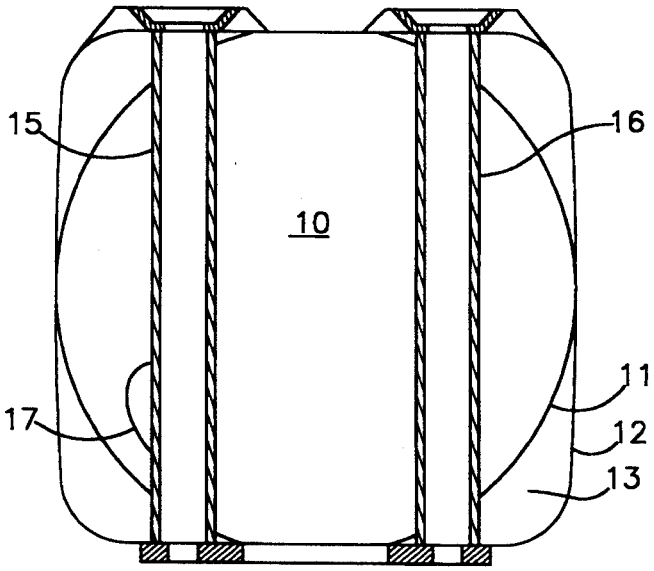
FIG. 3 is a sectional view taken along line III—III in FIG. 1.
Figure 4:
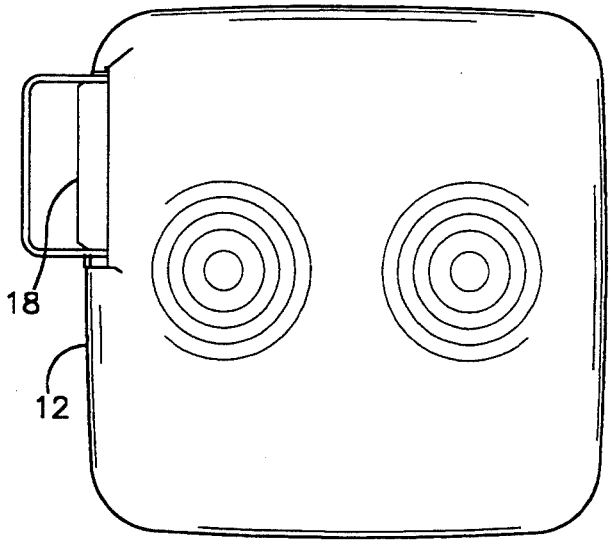
FIG. 4 is a rear view of the muffler shown in FIG. 1, FIGS. 5 and 6 are views corresponding to FIGS. 2 and 3 of a second embodiment of the muffler according to the invention.

Exhaust gases entering the inlet 14 from the engine expand in the primary chamber 10 and proceed through an opening 17 in the inner receptacle 11 into the secondary chamber 13, as shown by arrows in FIG. 2. The gas flow is distributed in this chamber in various directions around the inner receptacle and flows into the atmosphere through an outlet 18 provided at an opposite corner of the outer receptacle 12.

The shown construction of the two receptacles arranged one within the other constitutes a very rigid unit from the point of view of strength. The strength is improved further in that the two receptacles are attached to each other, preferably by soldering, at each of the points of abutment, i. e. at each of the six sides of the cubic outer receptacle. It has thereby appeared to be possible to make the muffler of thinner material which has resulted in a weight reduction of about 30%. It should be easily realized that this is of great importance in hand-held tools such as chain saws.

The described construction is also advantageous from an acoustic point of view in that the two chambers are generally equally large and in that the spherical form of the primary chamber causes sound waves to be reflected towards the center.

Figure 5:
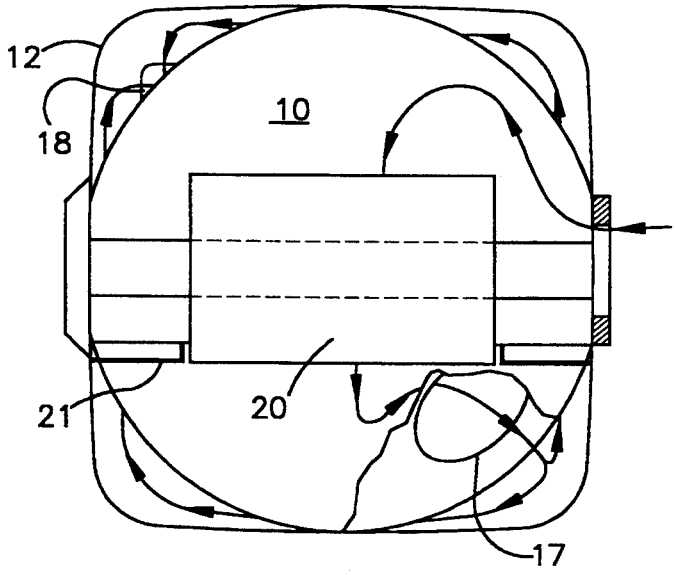
Figure 6:
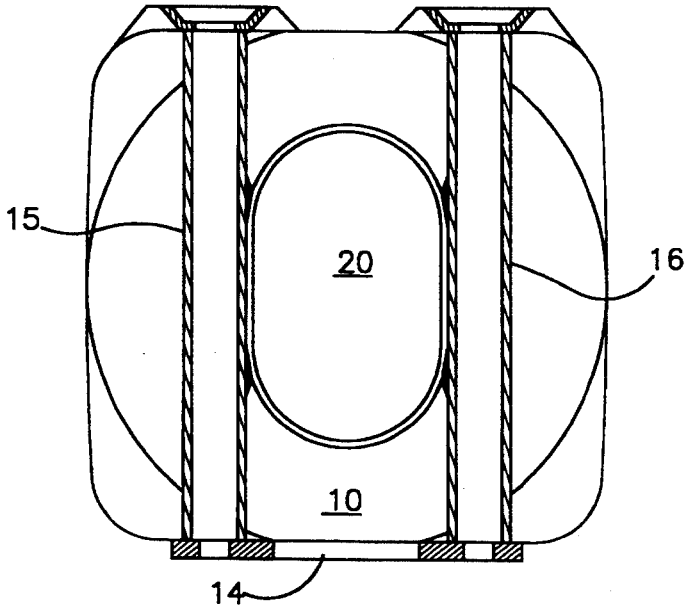
Figure 7:
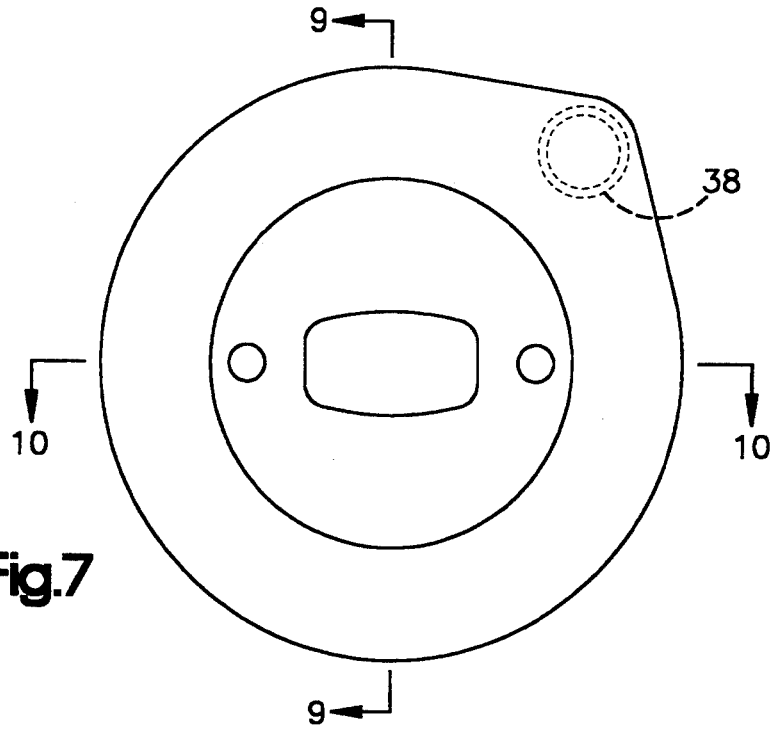
FIG. 7 is a front view of a third embodiment of the muffler.
Figure 8:
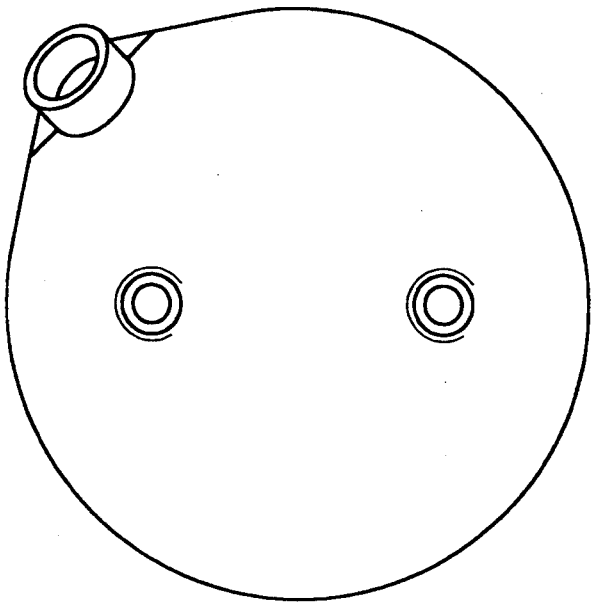
FIG. 8 is a rear end view of the muffler shown in FIG. 7.

The embodiment shown in FIGS. 5 and 6 comprises a catalyzer 20 which is provided in the primary chamber 10. The catalyzer is attached between the spacer tubes 15, 16, preferably by soldering. In order to force the exhaust gases to pass through the catalyzer, as shown by arrows in FIG. 5, a partition wall 21 is provided which extends between the periphery of the catalyzer and the wall of the inner receptacle 11. Otherwise this embodiment of the muffler is made as described above with reference to FIGS. 1–4.

In the embodiment shown in FIGS. 7–10, a primary chamber 30 is formed by an inner, spherical receptacle 31. A secondary chamber 33 is formed by the space between this receptacle and an outer receptacle 32 which is also spherical. As in the embodiments described above two spacer tubes 35 and 36 are provided for receiving fastening screws (not shown) for attaching the muffler to an engine. The spacer tubes extend through and are attached to both receptacles 31, 32 and thus provide supporting means for fixing the receptacles at the correct distance from each other. In this embodiment, too, the receptacles have such mutual dimensions that the volumes of the two chambers 31, 33 are generally equal.

Figure 9:
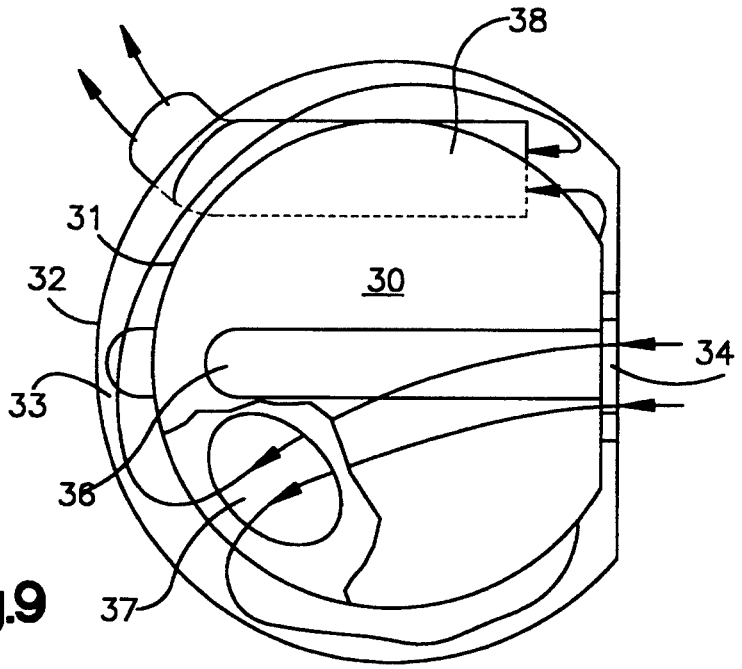
FIG. 9 is a sectional view taken along line IX—IX in FIG. 7.
Figure 10:
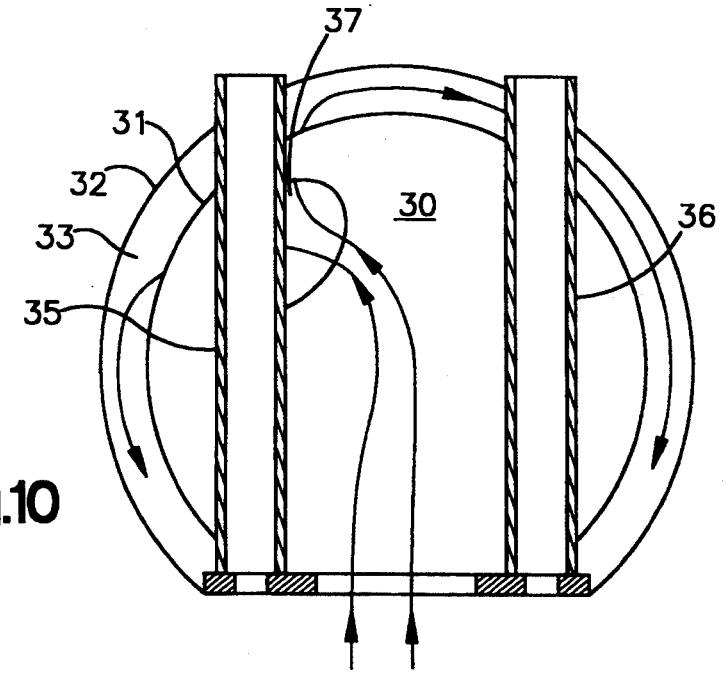
FIG. 10 is a sectional view taken along line X—X in FIG. 7.

The exhaust gases from a engine (not shown) enter the primary chamber 30 via an inlet 34 and proceed therefrom via an opening 37 into the secondary chamber 33, as is shown by the arrows in FIGS. 9, 10, and further to the inner end of an outlet tube 38 the outer end of which opens into the atmosphere. The inner end of the tube 38 is disposed at a diametrically opposite position relative to the opening 37.

Due to the shape of the sperical outer receptacle, which is advantageous from the point of view of strength, this embodiment makes it possible to obtain a certain further weight reduction in comparison with those described above in that a thinner material can be used. The acoustic features have also been improved in that the two receptacles have no direct contact with each other which provides for less sound transmission therebetween.

What is claimed is:

1. A muffler for an internal combustion engine, said muffler comprising a primary and a secondary chamber through which exhaust gases from the engine in turn flow, a generally spherically-shaped inner receptacle defining said primary chamber and having an outer diameter, and a generally cubically-shaped outer receptacle surrounding the inner receptacle, a space between an outer surface of said inner receptacle and an inner surface of said outer receptacle defining said secondary chamber, said outer receptacle having side walls with lengths generally equal to said outer diameter of said inner receptacle.

2. The muffler according to claim 1, wherein said inner receptacle is attached to at least one of said side walls of said outer receptacle.

3. The muffler according to claim 2, wherein said inner receptacle is attached to each of said side walls of said outer receptacle.

4. The muffler according to one of claims 1–3 further comprising a catalyzer disposed in the primary chamber such that said exhaust gasses flow through said catalyzer.

5. A muffler for an internal combustion engine having an exhaust port, said muffler comprising a generally spherically-shaped inner receptacle defining a primary chamber, said inner receptacle having an outer diameter and an inlet in communication with said exhaust port for admitting exhaust gasses into said primary chamber, and a generally cubically-shaped outer receptacle surrounding the inner receptacle, a space between an outer surface of said inner receptacle and an inner surface of said outer receptacle defining a secondary chamber, said inner receptacle having an opening communicating said primary chamber and said secondary chamber for passing said exhaust gases from said primary chamber to said secondary chamber, said outer receptacle having an outlet for passing said exhaust gasses from said secondary chamber to atmosphere, said outer receptacle having side walls with lengths generally equal to said outer diameter of said inner receptacle.

6. The muffler according to claim 6, wherein said inner receptacle is attached to at least one of said side walls of said outer receptacle.

7. The muffler according to claim 6, wherein said inner receptacle is attached to each of said side walls of said outer receptacle.

8. The muffler according to claim 5, further comprising a catalyzer in said primary chamber, said inner receptacle having a partition wall adapted for flowing all of said exhaust gasses through said catalyzer.

9. The muffler according to claim 5, wherein said outlet of the outer receptacle is located opposite said opening of said inner receptacle such that said exhaust gasses flow around said inner receptacle from said opening to said outlet.

* * * * *

UNITED STATES PATENT AND TRADEMARK OFFICE

CERTIFICATE OF CORRECTION

PATENT NO. : 5,422,444

DATED : June 6, 1995

INVENTOR(S) : Fridolf A. G. Doragrip

It is certified that error appears in the above-indentified patent and that said Letters Patent is hereby corrected as shown below:

On the title page, insert item 73 Aktiebolaget Electrolux, Stockholm, Sweden--.

On the title page, under item [56], insert Pearne, Gordon, McCoy & Granger--.

Column 1, line 11, delete "can be" and insert --is--; and line 53, delete "spherical-" and insert --spherically- --.

Signed and Sealed this

Ninth Day of January, 1996

Bruce Lehman

*Attest:*

BRUCE LEHMAN

*Attesting Officer*

*Commissioner of Patents and Trademarks*